US009164419B2

(12) United States Patent
Uneme

(10) Patent No.: US 9,164,419 B2
(45) Date of Patent: Oct. 20, 2015

(54) DEVELOPING CONTAINER, METHOD OF MANUFACTURING THE SAME, DEVELOPING DEVICE USING THE SAME, AND IMAGE FORMING APPARATUS

(71) Applicant: CANON KABUSHIKI KAISHA, Tokyo (JP)

(72) Inventor: Tetsushi Uneme, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 13/719,970

(22) Filed: Dec. 19, 2012

(65) Prior Publication Data

US 2013/0164022 A1 Jun. 27, 2013

(30) Foreign Application Priority Data

Dec. 21, 2011 (JP) ..... 2011-279583
Dec. 5, 2012 (JP) ..... 2012-266165

(51) Int. Cl.
*G03G 21/00* (2006.01)
*G03G 21/20* (2006.01)
*G03G 15/08* (2006.01)

(52) U.S. Cl.
CPC ..... *G03G 15/0812* (2013.01); *G03G 15/0898* (2013.01)

(58) Field of Classification Search
CPC ..... G03G 15/0894; G03G 2215/00987; G03G 21/1853; G03G 15/0896
USPC ..... 399/93, 98, 109, 111, 119
See application file for complete search history.

(56) References Cited

U.S. PATENT DOCUMENTS

| | | | | |
|---|---|---|---|---|
| 5,983,052 | A | 11/1999 | Fantuzzo et al. | |
| 5,999,769 | A | 12/1999 | Anderson et al. | |
| 8,275,283 | B2 | 9/2012 | Uneme et al. | |
| 8,401,441 | B2 | 3/2013 | Uneme et al. | |
| 2002/0131789 | A1 * | 9/2002 | Yokoi et al. | 399/103 |
| 2011/0103827 | A1 | 5/2011 | Uneme et al. | |

FOREIGN PATENT DOCUMENTS

| | | | |
|---|---|---|---|
| CN | 1441324 | A | 9/2003 |
| JP | 2003270939 | | 9/2003 |
| JP | 2009-053274 | A | 3/2009 |

OTHER PUBLICATIONS

Office Action in Chinese Patent Application No. 201210564200.0, mailed Jun. 30, 2014 (with English translation).

* cited by examiner

*Primary Examiner* — Hoang Ngo
(74) *Attorney, Agent, or Firm* — Fitzpatrick, Cella, Harper & Scinto

(57) ABSTRACT

A developing container configured to contain developer, the developing container including: a filter member which covers a communicating hole through which an inside and an outside of the developing container are communicated with each other; a fixing area where the filter member is fixed to the developing container; and a vibration regulating portion configured to regulate vibrations of the filter member on an inner side of the fixing area, wherein the filter member is configured to allow passage of air and regulate passage of the developer, and wherein the vibration regulating portion is provided so as to be hit by the filter member if the filter member is vibrated, in order to regulate the vibrations of the filter member.

26 Claims, 10 Drawing Sheets

DEVELOPING CONTAINER, METHOD OF MANUFACTURING THE SAME, DEVELOPING DEVICE USING THE SAME, AND IMAGE FORMING APPARATUS

BACKGROUND OF THE INVENTION

1. Field of the Invention

The present invention relates to a developing container configured to contain developer, a method of manufacturing the developing container, a developing device using the developing container, and an image forming apparatus.

2. Description of the Related Art

Image forming apparatus are typified by, for example, a copying machine, a printer (a laser beam printer and an LED printer), a facsimile machine, a multifunction peripheral combining those apparatus, and a word processor, which are configured to form an image on a recording medium through use of various image forming processes.

The various image forming processes are typified by, for example, an electrophotographic image forming process using an electrophotographic photosensitive member as an image bearing member on which a latent image is to be formed, an electrostatographic image forming process using an electrostatographic dielectric member as the image bearing member, and a magnetographic image forming process using a magnetographic magnetic member as the image bearing member. The image bearing member on which a latent image is to be formed includes a rotary member such as a drum and an endless belt, and a sheet member such as a photosensitive sheet and an electrostatographic sheet.

A developing device refers to a device configured to develop a latent image formed on the image bearing member with developer, and includes at least a developing container configured to contain the developer, and a developing member configured to develop a latent image by applying, to the image bearing member, the developer contained in the developing container.

A process cartridge refers to a cartridge detachably mountable to an apparatus main body of an image forming apparatus configured to form an image on a recording medium, and includes at least an image bearing member, and a developing device configured to develop a latent image formed on the image bearing member with developer. The developing device includes at least a developing container configured to contain developer, and a developing member configured to develop a latent image by applying, to the image bearing member, the developer contained in the developing container. The apparatus main body refers to a part of the image forming apparatus excluding the developing device or the process cartridge.

The recording medium refers to a recording material on which an image can be formed, and is typified by, for example, a recording sheet, a resin sheet, a cloth, an envelope, and a postcard. The recording medium also includes an intermediate transfer belt, an intermediate transfer drum, and a display of an image display apparatus.

In the following description, the developer is referred to as "toner." Further, the developing member configured to develop a latent image with developer by applying the developer to the image bearing member is referred to as "a developing roller."

The developing device, the developing cartridge, and the process cartridge as described above are provided with an elastic sheet member (toner seal member) which abuts against the rotating developing roller over the length in its axial direction (roller longitudinal direction) to prevent leakage of toner through a space between the developing container and the developing roller. Further, the developing container is provided with a developing blade configured to regulate the thickness of a toner layer.

In the above-mentioned structure, the developing container, the developing roller, or a toner supply roller configured to supply toner to the developing roller may be deformed due to a change in atmospheric pressure and an impact during distribution, and hence the volume inside the developing container may be reduced. In this case, the atmospheric pressure inside the developing container becomes higher than the atmospheric pressure outside the developing container, and hence toner may leak through a space between the developing roller and the elastic sheet member or between the developing roller and the developing blade. This is because air blows out of the developing container due to the difference between the atmospheric pressure inside the developing container and the atmospheric pressure outside the developing container, which causes toner leakage concomitantly.

Therefore, in the developing device, the developing cartridge, and the process cartridge disclosed in U.S. Patent Application Publication No. US 2011/0103827 and Japanese Patent Application Laid-Open No. 2003-270939, a communicating hole through which the inside and outside of the developing container are communicated with each other is provided. Further, a filter member which allows passage of air and blocks passage of toner is provided so as to close the communicating hole. With this structure, the change in pressure inside the developing container is reduced.

However, when the developing container is formed of a plurality of frames such as a container and a cover, the communicating hole through which the inside and outside of the developing container are communicated with each other is provided in the container or the cover. After the filter member is bonded so as to close the communicating hole, the container and the cover are welded together by vibration welding, to thereby form the developing container. In this case, due to the vibrations generated in the vibration welding, the filter member bonded to the communicating hole vibrates like a drumbeat, and vibrational energy of the filter member is converted into thermal energy due to the friction and deformation occurring inside the filter member. The thermal energy raises the temperature of the filter member. As a result, the filter member may be melted.

SUMMARY OF THE INVENTION

The present invention has been made in view of the above-mentioned circumstances, and provides a developing container which reduces a risk of melting a filter member.

Thus, according to an exemplary embodiment of the present invention, a developing container configured to contain developer includes: a filter member which covers a communicating hole through which an inside and an outside of the developing container are communicated with each other; a fixing area where the filter member is fixed to the developing container; and a vibration regulating portion configured to regulate vibrations of the filter member on an inner side of the fixing area, wherein the filter member is configured to allow passage of air and regulate passage of the developer, and wherein the vibration regulating portion is provided so as to be hit by the filter member if the filter member is vibrated, in order to regulate the vibrations of the filter member.

Exemplary embodiments of the present invention provide a method of manufacturing a developing container, a developing device using a developing container, and an image forming apparatus.

According to the present invention, the developing container is configured to reduce the vibrations of the filter member to be generated when the developing container is processed by vibration welding, and accordingly suppress the heat generation when the filter member vibrates, thereby reducing the risk of melting the filter member.

Further, according to the present invention, it is possible to reduce the risk of melting the filter member which causes decrease in ventilation performance.

Further features of the present invention will become apparent from the following description of exemplary embodiments with reference to the attached drawings.

DESCRIPTION OF THE EMBODIMENTS

In the following, an exemplary embodiment of the present invention will be described. Note that, in the following embodiment, a full-color image forming apparatus to which a developing device and a process cartridge are detachably mountable will be described as an example of an image forming apparatus. However, the number of process cartridges to be mounted on the image forming apparatus is not limited to the following embodiment, and may be set appropriately as necessary.

For example, in a case of an image forming apparatus configured to form a monochrome image, a single process cartridge is mounted on the image forming apparatus. Further, according to the embodiment described below, a printer will be described as an example of the image forming apparatus. However, the present invention is not limited thereto. For example, the present invention is also applicable to other image forming apparatus such as a copying machine, a facsimile machine, and a multifunction peripheral combining the functions of those apparatus.

(Schematic Structure of Image Forming Apparatus)

Figure 2:
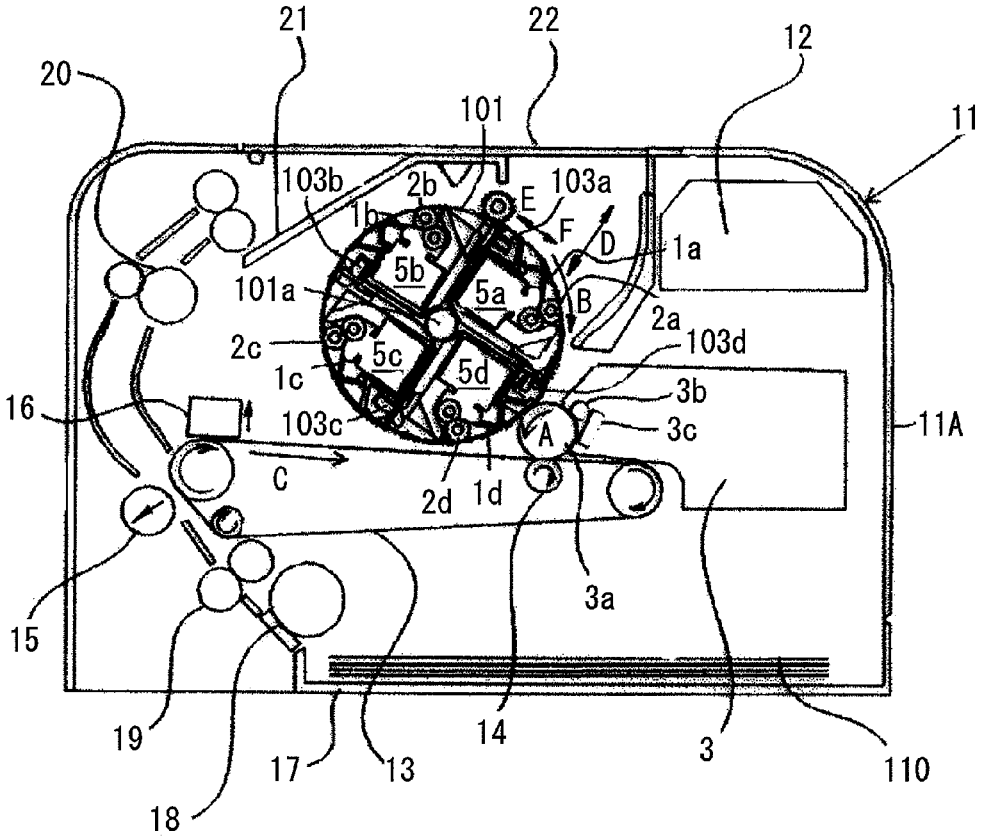
FIG. 2 is a schematic sectional view of illustrating an example of an image forming apparatus.

First, an image forming operation of the image forming apparatus according to the embodiment will be described with reference to FIG. 2. An image forming apparatus 11 according to the embodiment is a full-color electrophotographic laser beam printer using four colors. FIG. 2 is a sectional view of illustrating the schematic structure of the laser beam printer. That is, the image forming apparatus 11 forms an image on a sheet of recording material (final recording medium) 110 based on image information (electric image signal) input from an external host apparatus (not shown) to a control circuit portion (not shown). The external host apparatus is a personal computer, an image reading apparatus, a network, or a facsimile machine.

The image forming apparatus 11 includes a photosensitive drum 3*a* as an image bearing member. Around the photosensitive drum 3*a*, a charging unit 3*b*, an exposure unit 12, a developing unit 5 (5*a*, 5*b*, 5*c*, and 5*d*), and a cleaning unit 3*c* are arranged as process units which act on the photosensitive drum 3*a*.

The charging unit 3*b* uniformly charges the surface of the photosensitive drum 3*a* at a predetermined polarity and potential. In the embodiment, the charging unit 3*b* is a contact charging roller. The exposure unit 12 exposes to light the uniformly charged surface of the photosensitive drum 3*a* to form a latent image. In the embodiment, the exposure unit 12 is a laser scanner. That is, the exposure unit 12 irradiates the photosensitive drum 3*a* with laser light which is modulated corresponding to the image information, to thereby form a latent image.

The developing unit 5 develops the latent image formed on the photosensitive drum 3*a* with developer (hereinafter referred to as "toner") into a toner image. In the embodiment, the developing unit 5 includes four developing devices configured to develop the latent image formed on the photosensitive drum 3*a* with toner of the corresponding colors to visualize the image. Specifically, the developing unit 5 includes a yellow developing device 5*a*, a magenta developing device 5*b*, a cyan developing device 5*c*, and a black developing device 5*d*.

The cleaning unit 3*c* removes transfer residual toner from the photosensitive drum 3*a*. In the embodiment, the cleaning unit 3*c* is a blade cleaning device.

In the embodiment, the photosensitive drum 3*a*, the charging unit 3*b*, and the cleaning unit 3*c* are constructed integrally in the form of a drum cartridge 3 (so-called separate process cartridge which does not include the developing unit) which is detachably mountable to an apparatus main body 11A of the image forming apparatus 11. The photosensitive drum 3*a*, the charging unit 3*b*, and the cleaning unit 3*c* may be constructed independently of one another or may be constructed integrally with one another.

Further, in the embodiment, the yellow developing device 5*a*, the magenta developing device 5*b*, the cyan developing device 5*c*, and the black developing device 5*d* are held by a rotary holder 101 which is rotatably mounted on the apparatus main body 11A of the image forming apparatus 11. The yellow developing device 5*a*, the magenta developing device 5*b*, the cyan developing device 5*c*, and the black developing device 5*d* may be a fixed type which is fixed to the rotary holder 101, or may be a developing cartridge type which is detachably mountable to the rotary holder 101.

The yellow developing device 5*a*, the magenta developing device 5*b*, the cyan developing device 5*c*, and the black developing device 5*d* employed in the embodiment are a developing cartridge type which is detachably mountable to the rotary holder 101. Therefore, the yellow developing device 5*a*, the magenta developing device 5*b*, the cyan developing device 5*c*, and the black developing device 5*d* will be explained as "yellow developing cartridge 5*a*," "magenta developing cartridge 5*b*," "cyan developing cartridge 5*c*," and "black developing cartridge 5*d*," respectively.

Each of the developing cartridges 5*a*, 5*b*, 5*c*, and 5*d* is detachably mountable to the rotary holder 101 in the apparatus main body 11A of the image forming apparatus 11 by a predetermined procedure. Specifically, an openable and closeable door 22 located in the top surface of the image forming apparatus 11 is opened so as to open the inside of the apparatus, and through the opening portion thus opened, each developing cartridge is detachably mountable to a predetermined mounting portion of the rotary holder 101 by a predetermined procedure.

The structures of the rotary holder 101 configured to hold the yellow developing cartridge 5*a*, the magenta developing cartridge 5*b*, the cyan developing cartridge 5*c*, and the black developing cartridge 5*d*, respectively, have the same construction. Thus, in the embodiment, the yellow developing cartridge 5*a* is taken as a representative in the description of the structures of the rotary holder 101 configured to hold the yellow developing cartridge 5*a*, the magenta developing cartridge 5*b*, the cyan developing cartridge 5*c*, and the black developing cartridge 5*d*.

Figure 4:
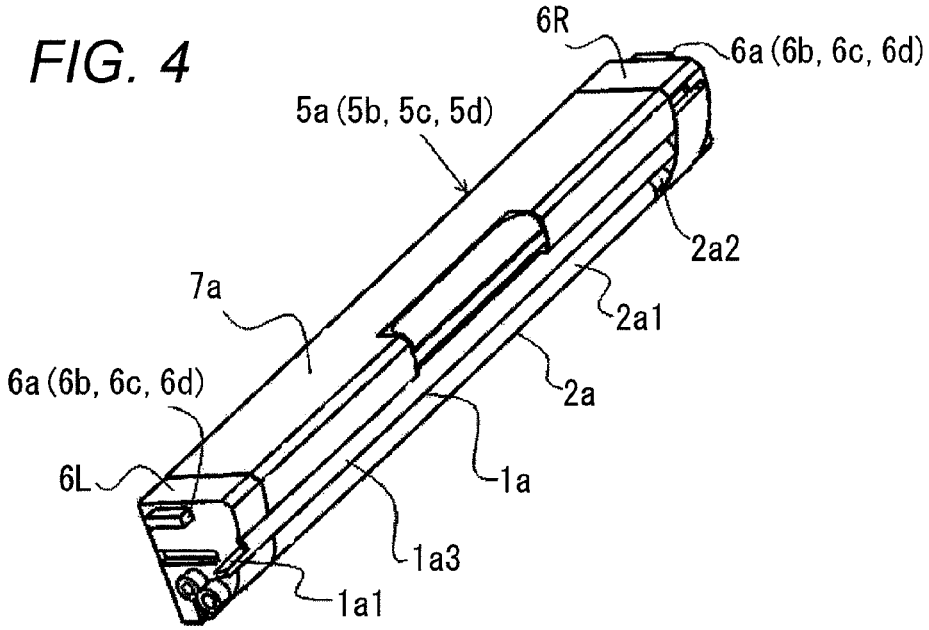
FIG. 4 is a perspective view of illustrating an external appearance of the developing cartridge.

The yellow developing cartridge 5*a* is mounted on the rotary holder 101, and portions 6*a* to be locked which are provided on the yellow developing cartridge 5*a* illustrated in FIG. 4 engage with developing cartridge locking members 103*a* which are provided in the rotary holder 101 illustrated in FIG. 2. Accordingly, inadvertent ejection of the developing cartridge from the rotary holder 101 is suppressed.

The developing cartridge locking members 103*a* are each movable in the directions indicated by the arrows E and F by springs (not shown). The developing cartridge locking members 103*a* move in the direction indicated by the arrow E while the yellow developing cartridge 5*a* is being mounting. When the mounting of the yellow developing cartridge 5*a* is completed, the developing cartridge locking members 103*a* are urged in the direction indicated by the arrow F by the springs. Accordingly, the developing cartridge locking members 103*a* engage with the yellow developing cartridge 5*a* to regulate the movement of the yellow developing cartridge 5*a* in the direction indicated by the arrow D of FIG. 2.

Similarly, portions 6*b*, 6*c*, and 6*d* to be locked are provided on the magenta developing cartridge 5*b*, the cyan developing cartridge 5*c*, and the black developing cartridge 5*d*, respectively. The portions 6*b*, 6*c*, and 6*d* to be locked respectively engage with developing cartridge locking members 103*b*, 103*c*, and 103*d* which are provided in the rotary holder 101. Accordingly, an inadvertent ejection of the developing cartridges from the rotary holder 101 is suppressed.

Figure 3A:
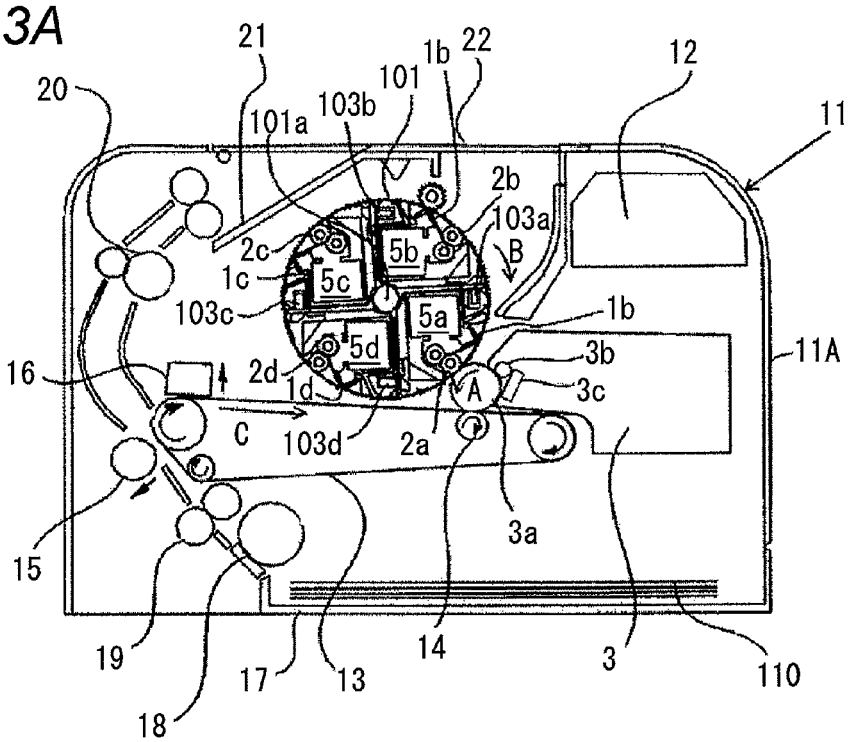
FIGS. 3A and 3B are explanatory views of illustrating an image forming operation.
Figure 3B:
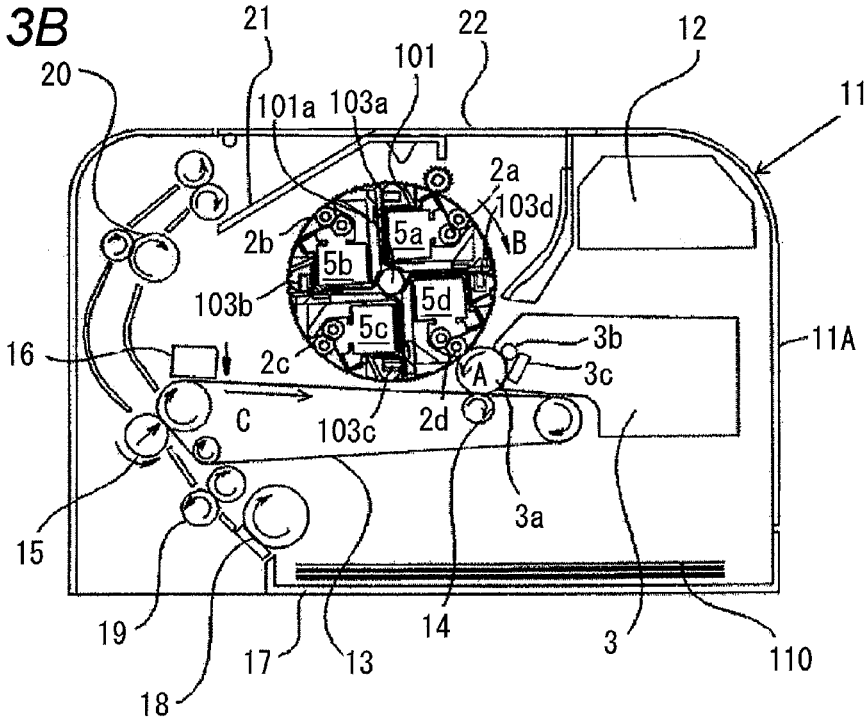

FIGS. 2, 3A, and 3B illustrate an image forming operation. First, the photosensitive drum 3*a* is rotated in the direction indicated by the arrow A of FIG. 2. In synchronization with the rotation of the photosensitive drum 3*a*, an intermediate transfer belt 13 is rotated in the direction indicated by the arrow C of FIG. 2. Then, the charging unit 3*b* uniformly charges the surface of the photosensitive drum 3*a*, and the exposure unit 12 performs light irradiation according to a yellow image to form a yellow electrostatic latent image on the photosensitive drum 3*a*.

Simultaneously with the formation of the electrostatic latent image, the rotary holder 101 which is rotatable and holds the above-mentioned four developing cartridges is rotated by around 45° in the direction indicated by the arrow B of FIG. 2 about a rotary holder rotation shaft 101*a* by a drive transmission mechanism (not shown) provided in the image forming apparatus 11. Accordingly, the yellow developing cartridge 5*a* is brought to a developing position in which a developing roller (developer carrying member) 2*a* serving as a developing member is located opposite to the photosensitive drum 3*a* as in the state illustrated in FIG. 3A. Developing blades 1*a*, 1*b*, 1*c*, and 1*d* are provided in the developing cartridges 5*a*, 5*b*, 5*c*, and 5*d*, respectively.

Then, a potential difference is provided between the photosensitive drum 3*a* and the developing roller 2*a* so that yellow developer adheres to the latent image formed on the photosensitive drum 3*a*. Accordingly, the latent image formed on the photosensitive drum 3*a* is developed by making the yellow developer adhere to the latent image. That is, a yellow developer image is formed on the photosensitive drum 3*a*.

After that, a voltage having a polarity reverse to the polarity of toner is applied to a primary transfer roller 14 arranged on the inner side of the intermediate transfer belt 13, and hence the yellow toner image on the photosensitive drum 3*a* is primarily transferred onto the intermediate transfer belt 13.

When the yellow toner image is primarily transferred in the manner as described above, the rotary holder 101 is driven by the drive transmission mechanism of the image forming apparatus 11 to rotate intermittently by 90° each time in the direction indicated by the arrow B of FIG. 3A. Accordingly, the magenta developing cartridge 5*b*, the cyan developing cartridge 5*c*, and the black developing cartridge 5*d* are sequentially positioned in the developing position in which developing rollers 2*b*, 2*c*, and 2*d* are sequentially located opposite to the photosensitive drum 3*a*.

Accordingly, similarly to the case of the yellow image, magenta, cyan, and black electrostatic latent images are formed and developed, and then the respective toner images are primarily transferred sequentially. Thus, the toner images of four colors are superimposed on the intermediate transfer belt 13.

Meanwhile, as illustrated in FIG. 3A, a secondary transfer roller 15 is out of contact with the intermediate transfer belt 13. Also, a cleaning unit 16 of the intermediate transfer belt 13 is out of contact with the intermediate transfer belt 13.

On the other hand, the sheets (recording materials) 110 are contained in a stacked manner in a sheet feeding cassette 17 provided in a lower portion of the image forming apparatus, and each sheet 110 is separated from the others and fed by a sheet feeding roller 18 from the sheet feeding cassette 17 to conveyance rollers 19. The conveyance rollers 19 send the fed sheet 110 into between the intermediate transfer belt 13 and the secondary transfer roller 15.

The leading end of the four-color toner images superimposed on the intermediate transfer belt 13 to which the toner image of black as a final color is transferred reaches the position in the front of the secondary transfer roller 15 through the rotation of the intermediate transfer belt 13. At this timing, as illustrated in FIG. 3B, the secondary transfer roller 15 is brought into pressure contact with the intermediate transfer belt 13. Further, a voltage having a polarity reverse to the polarity of toner is applied to the secondary transfer roller 15. Hence the above-mentioned four-color toner images superimposed on the intermediate transfer belt 13 are secondarily transferred onto the surface of the conveyed sheet 110 in a sequential manner.

The sheet 110 to which the toner images are transferred is sent to a fixing device 20. The fixing device 20 heats and pressurizes the sheet 110 to fix the toner images onto the sheet 110. Accordingly, the image is formed on the sheet 110. After that, the sheet 110 is delivered from the fixing device 20 to a sheet delivery portion 21 located outside the image forming apparatus 11.

(Structure of Developing Cartridge)

The yellow developing cartridge 5*a*, the magenta developing cartridge 5*b*, the cyan developing cartridge 5*c*, and the black developing cartridge 5*d* have the same structure. Thus, in the embodiment, the yellow developing cartridge 5*a* illustrated in FIGS. 4, 5A, 5B, 5C, and 6 is taken as a representative in the description of the structure of the yellow developing cartridge 5*a*, the magenta developing cartridge 5*b*, the cyan developing cartridge 5*c*, and the black developing cartridge 5*d*.

Figure 5A:
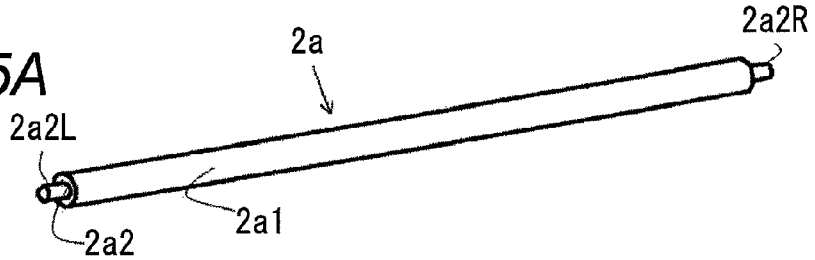
FIGS. 5A, 5B, and 5C are explanatory views of illustrating the structures of the developing cartridge.

As illustrated in FIG. 5A, the developing roller 2*a* serving as the developing member configured to develop a latent image by applying toner to the photosensitive drum 3*a* serving as the image bearing member includes a rubber roller portion 2*a*1 and a rigid shaft 2*a*2. The rigid shaft 2*a*2 extends through the rubber roller portion 2*a*1 in a rotation axis direction of the developing roller 2*a*. Both ends of the rigid shaft 2*a*2 serve as projections 2*a*2L and 2*a*2R which project from the rubber roller portion 2*a*1.

Figure 5B:
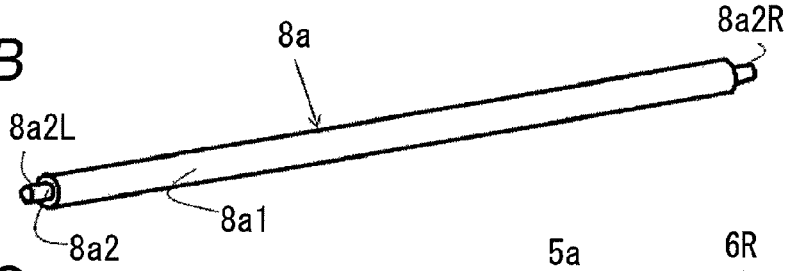

A toner supply roller 8*a* supplies toner to the developing roller 2*a*. As illustrated in FIG. 5B, the toner supply roller 8*a* includes a sponge roller 8*a*1 and a rigid shaft 8*a*2. The rigid shaft 8*a*2 extends through the sponge roller 8*a*1 in a rotation axis direction of the toner supply roller 8*a*. Both ends of the rigid shaft 8*a*2 serve as projections 8*a*2L and 8*a*2R which project from the sponge roller 8*a*1.

Figure 5C:
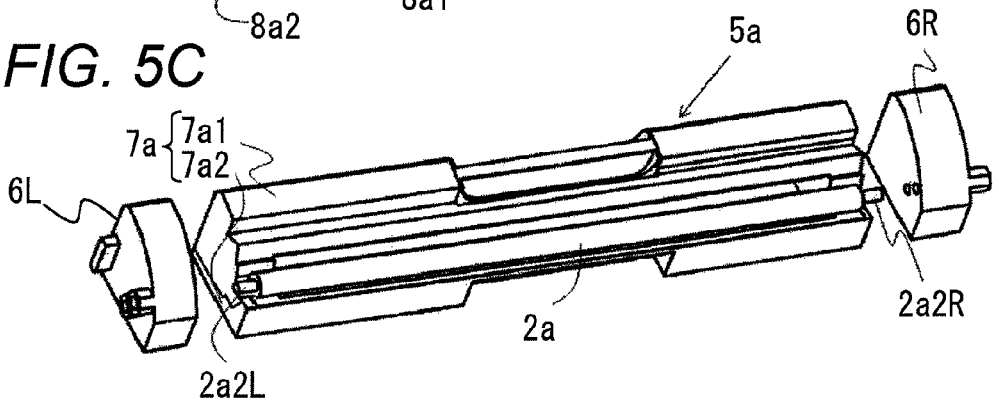

As illustrated in FIG. 5C, the yellow developing cartridge 5*a* rotatably holds the developing roller 2*a* through use of side members 6L and 6R configured to hold the projections 2*a*2L and 2*a*2R of the developing roller 2*a*, respectively.

A developing container 7*a* is formed of two frames, that is, a container 7*a*1 and a cover 7*a*2, and contains toner 10. In a developing chamber 7*b* arranged inside the developing container 7*a*, the developing roller 2*a*, the toner supply roller 8*a*, and the developing blade 1*a* are arranged. The toner 10 in the developing container 7*a* is supplied to the toner supply roller 8*a*. The toner supply roller 8*a* is rotated in the direction indicated by the arrow H of FIG. 6 to supply the toner 10 to the developing roller 2*a*. The developing roller 2*a* is rotated in the direction indicated by the arrow J of FIG. 6. The toner 10 on the developing roller 2*a* is regulated by the developing blade 1*a* and developed onto the photosensitive drum 3*a*.

The toner 10 remaining on the developing roller 2*a* after the development is removed by the toner supply roller 8*a*. After that, the toner supply roller 8*a* supplies the toner again to the developing roller 2*a*. In order to provide a potential difference between the developing roller 2*a* and the photosensitive drum 3*a*, a predetermined voltage is supplied from a power supply portion (not shown) in the apparatus main body 11A to the developing roller 2*a*. A predetermined voltage is supplied from a power supply portion (not shown) in the apparatus main body 11A to the toner supply roller 8*a* as well. In FIG. 4, the developing blade 1*a* includes a base plate 1*a*3 and locking portions 1*a*1 provided at both ends of the base plate 1*a*3 in its longitudinal direction. The locking portions 1*a*1 are locked by the respective portions to be locked of the side members 6L and 6R.

Figure 6:
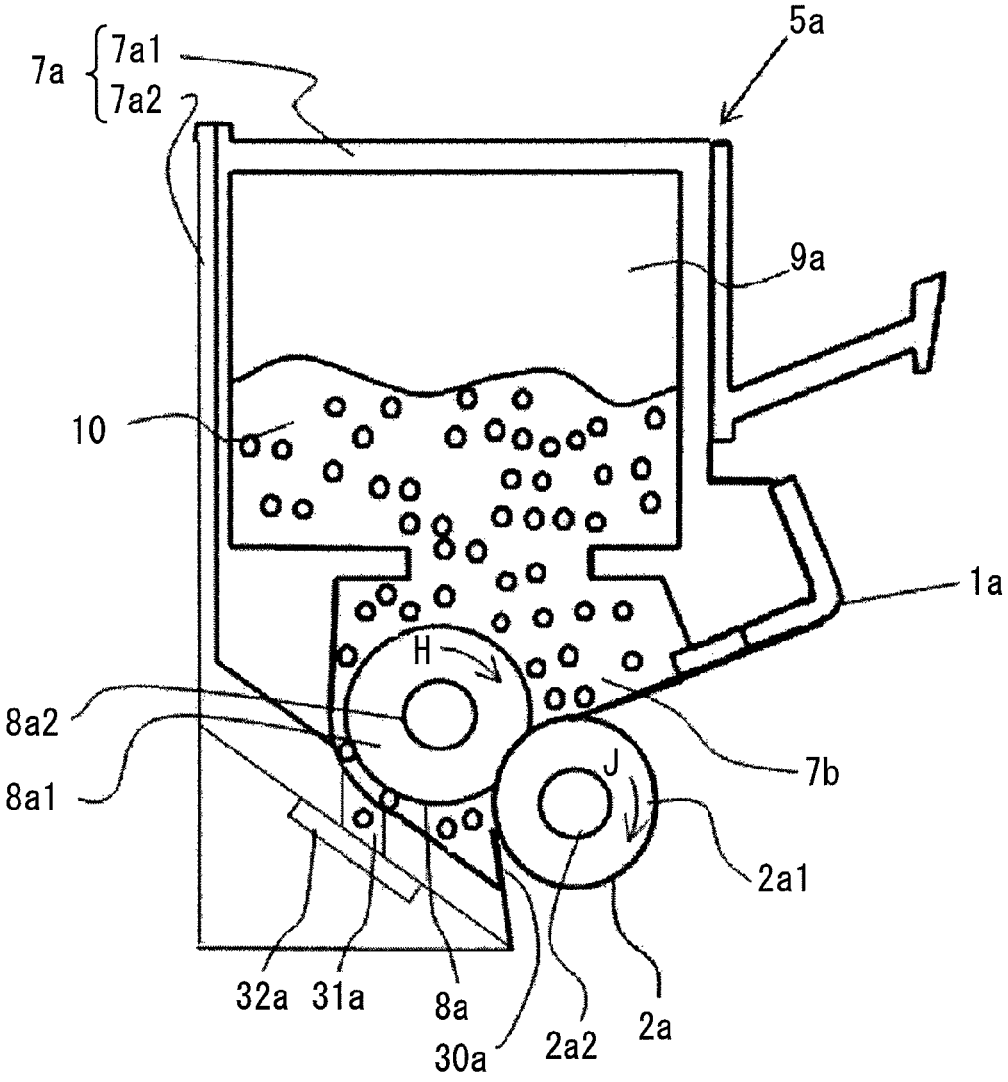
FIG. 6 is a schematic sectional view of the developing cartridge.

As illustrated in FIG. 6, in order to prevent leakage of toner through a space between the developing container 7*a* and the rubber roller portion 2*a*1, which is a surface of the developing roller 2*a* abutting against the toner supply roller 8*a*, an elastic sheet member 30*a* is provided as a toner seal member.

The elastic sheet member 30*a* is fixed to the developing container 7*a*, and abuts against the rubber roller portion 2*a*1 over the entire developing area of the rubber roller portion 2*a*1 in the rotation axis direction. That is, the developing cartridge 5*a* includes the sheet member 30*a* which is fixed to the developing container 7*a* at a proximal end of the sheet member 30*a* and abuts against the developing roller 2*a* at a distal end of the sheet member 30*a*, to thereby prevent leakage of toner from the developing container 7*a*. At this time, the elastic sheet member 30*a* abuts against the developing roller 2*a* at a low abutment pressure. When the abutment pressure at which the elastic sheet member 30*a* abuts against the developing roller 2*a* is high, the toner layer on the developing roller 2*a* is disturbed, which may result in an image defect.

Further, at the developing position, in order that the developing roller 2*a* stably abuts against the photosensitive drum 3*a*, the rotary holder 101 which holds the yellow developing cartridge 5*a* is urged toward the photosensitive drum 3*a*. Accordingly, the developing roller 2*a* of the yellow developing cartridge 5*a* is brought into pressure contact with the photosensitive drum 3*a* at a predetermined pressure force.

(Structures of Communicating Hole and Filter Member)

Figure 1A:
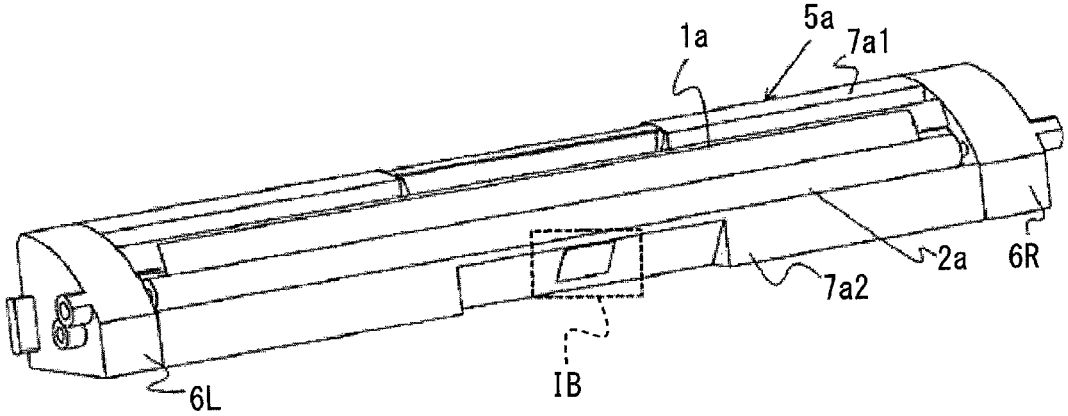
FIG. 1A is a perspective view of a developing cartridge according to an embodiment.
Figure 1B:
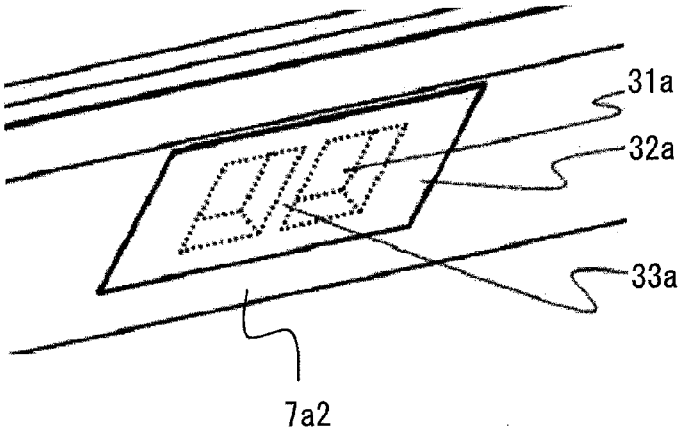
FIG. 1B is a view of a vibration regulating portion in a framed rectangle area IB of FIG. 1A.

Next, exemplary structures will be described regarding the structures of communicating holes 31 (31*a*, 31*b*, 31*c*, and 31*d*) and filter members 32 (32*a*, 32*b*, 32*c*, and 32*d*) in the respective developing cartridges 5*a*, 5*b*, 5*c*, and 5*d*. In the embodiment, a description will be provided with reference to FIGS. 1A and 1B as schematic views of the yellow developing cartridge 5*a*, and to FIG. 6 as a sectional view of the yellow developing cartridge 5*a*. FIG. 1A is a perspective view of the yellow developing cartridge 5*a*. FIG. 1B is a view of a vibration regulating portion 33*a* in a framed rectangle area IB of FIG. 1A.

The communicating hole 31*a* is formed in the developing container 7*a* so that the inside and outside of the developing container communicates with each other through the communicating hole 31*a*. That is, the communicating hole 31*a* is provided so as to communicate an inner area 9*a* of the yellow developing cartridge illustrated in FIG. 6, which is surrounded by the inner surface of the developing container 7*a*, the developing blade 1*a*, the developing roller 2*a*, and the elastic sheet member 30*a*, with an outer area of the yellow developing cartridge 5*a*. The communicating hole 31*a* is formed in the cover 7*a*2 which forms the developing container 7*a*, but may instead be provided in the container 7*a*1.

The filter member 32*a* which allows passage of air and regulates (blocks) passage of toner through the communicating hole 31 of the developing container 7*a* is provided so as to cover the communicating hole 31*a*. The filter member 32*a* is fixed to a fixing area of the inner or outer surface of the developing container 7*a* by heat welding, but the method of fixing the filter member 32*a* is not limited thereto. The average particle diameter of the toner 10 to be used is 6 μm to 8 μm. The filter member 32*a* employed herein is obtained by layering non-woven fabrics made of polyester fibers, and has ventilation pores with a diameter of 1 μm to 5 μm. Note that, any material may be employed as long as the material can allow passage of air and regulate (block) passage of toner.

In the embodiment, the drum cartridge 3 including at least the photosensitive drum 3*a* and the charging roller (charging unit) 3*b* is independent of the developing cartridge (developing unit) 5 including at least the developing roller 2. Alternatively, a so-called integrated process cartridge structure may be employed, in which the drum cartridge 3 and the developing cartridge 5 are integrated with each other.

The integrated process cartridge refers to a cartridge detachably mountable to an apparatus main body of an image forming apparatus configured to form an image on a recording medium, and includes at least an image bearing member, and a developing device configured to develop a latent image formed on the image bearing member with powder developer. The developing device includes at least a developing container configured to contain powder developer, and a developing member configured to develop a latent image by applying, to the image bearing member, the powder developer contained in the developing container.

Also in the case of the integrated process cartridge as described above, for example, when the developing container, the developing roller, or the toner supply roller is deformed due to the difference between the atmospheric pressure inside the developing container and the atmospheric pressure outside the developing container, or due to an impact during distribution, the atmospheric pressure inside the developing container becomes higher than the atmospheric pressure outside the developing container. At this time, the change in pressure inside the developing container can be reduced.

(Assembly Structure of Developing Container (Method of Manufacturing Developing Container))

Figure 7A:
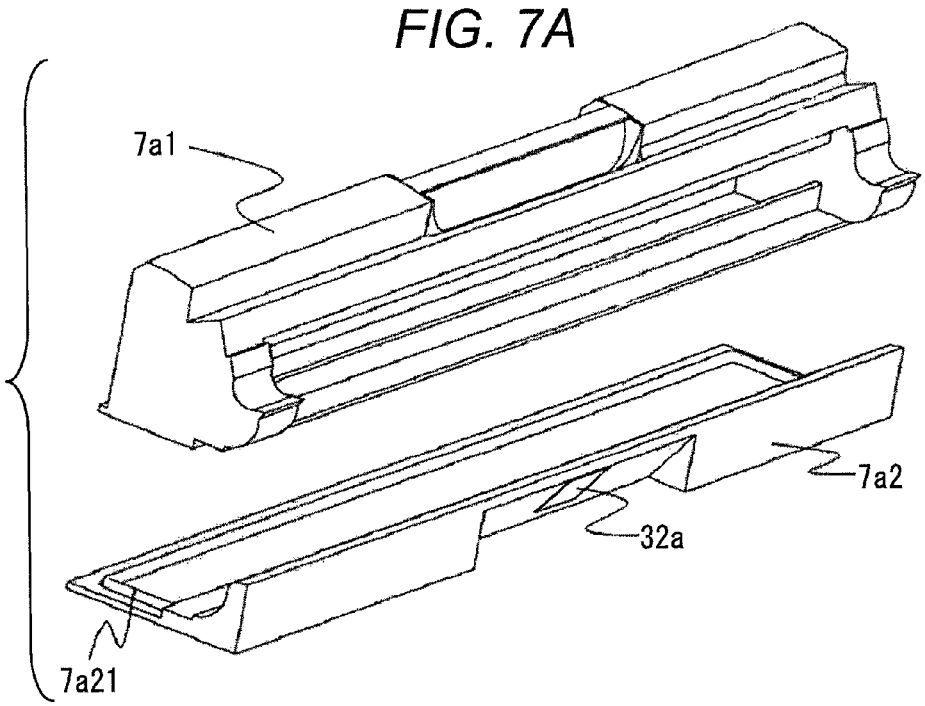
FIGS. 7A, 7B, and 7C are explanatory views of illustrating procedures of assembling a developing container.
Figure 7B:
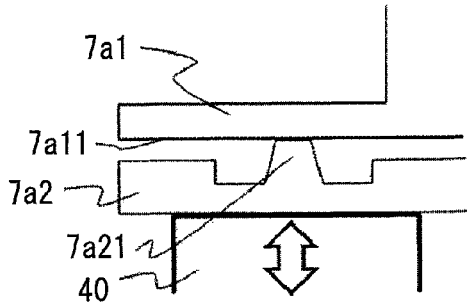
Figure 7C:
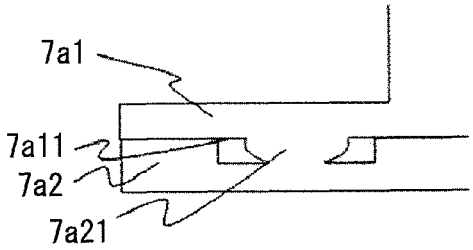

Next, an exemplary structure will be described regarding the assembly structure of the developing container 7. A description is provided of the embodiment with reference to FIGS. 7A, 7B, and 7C of illustrating the assembly of the yellow developing cartridge 5*a*. FIG. 7A schematically illustrates the container (first frame) 7*a*1 and the cover (second frame) 7*a*2 according to the embodiment. FIGS. 7B and 7C illustrate cross sections of a welding surface 7*a*11 and a rib-shaped protrusion (hereinafter referred to as "welding rib") 7*a*21 at which the container 7*a*1 and the cover 7*a*2 are joined to each other by welding.

The developing container 7*a* comprises two frames, that is, the container 7*a*1 and the cover 7*a*2. The container 7*a*1 has an enough volume to hold the toner 10, and serves as a holding member configured to hold the toner (see FIG. 6). On the other hand, the cover 7*a*2 serves as a cover configured to cover an opening of the container 7*a*1.

As a first step of manufacturing a frame, the cover 7*a*2, the vibration regulating portion and the communicating hole are integrally molded into the frame. Then, in the embodiment, as illustrated in FIG. 7A, the filter member 32*a* is fixed to the cover 7*a*2 so that the frame in which the communicating hole 31*a* of the cover 7*a*2 is covered with the filter member 32*a* is provided (providing step). After that, the cover 7*a*2 and the container 7*a*1 are fixed (joined) to each other by ultrasonic welding (welding step). In the embodiment, the ultrasonic welding is employed, but the cover 7*a*2 and the container 7*a*1 may be fixed to each other by vibration welding instead of the ultrasonic welding. At this time, as illustrated in FIG. 7B, the welding rib 7*a*21 provided on the cover 7*a*2 abuts against the welding surface 7*a*11 of the container 7*a*1, and vibrations are applied through use of a welding horn 40 from the surface of the cover 7*a*2 opposite to the surface on which the welding rib 7*a*21 is provided.

As the conditions for applying vibrations in the ultrasonic welding, the welding horn 40 abuts the surface at a pressure of 200 kPa, and vibrations of a frequency of 40 kHz are applied. Due to vibrational energy generated at this time, vibration and friction occur between the welding surface 7*a*11 and the welding rib 7*a*21 so that the vibrational energy is converted into thermal energy. As a result, the welding rib 7*a*21 is melted. Accordingly, as illustrated in FIG. 7C, the melted welding rib 7*a*21 and the welding surface 7*a*11 are welded to each other, and thus the developing container 7*a* is manufactured. The shape of the welding rib 7*a*21 is not limited as long as the welding rib 7*a*21 has a thin contact surface with respect to the welding surface (surface to be welded) 7*a*11. The conditions for applying vibrations in the ultrasonic welding differ depending on the shape of the welding rib.

(Structure of Vibration Regulating Portion)

Next, an exemplary structure will be described regarding the vibration regulating portion 33 according to the present invention with reference to FIGS. 8A, 8B, 9A, 9B, 9C, 9D, 10A, and 10B as schematic views of a ventilation hole portion of the yellow developing cartridge 5*a*.

The filter member 32*a* is fixed to the cover 7*a*2 of the developing container 7*a* at a filter member fixing portion 32*a*1 surrounding the periphery (the edge of the communicating hole 31*a*) of the communicating hole 31*a*. The area on the developing container side corresponding to the filter member fixing portion is referred to as "fixing area." At this time, the vibration regulating portion 33*a* is a member arranged on the inner side of the fixing area or the inner side of the edge of the communicating hole 31*a* along the filter member fixing portion 32*a*1 so that the vibration regulating portion 33*a* is hit by the surface of the filter member 32*a* if the filter is vibrated. That is, the vibration regulating portion 33*a* is integrally formed in the cover 7*a*2 of the developing container 7*a*, and is provided in such a positional relationship that the vibration regulating portion 33*a* is hit by the filter member 32*a* on the inner side of the fixing area. The vibration regulating portion may be arranged so that the vibration regulating portion abuts against the filter member even in a state in which the filter member is not vibrated.

Figure 8A:
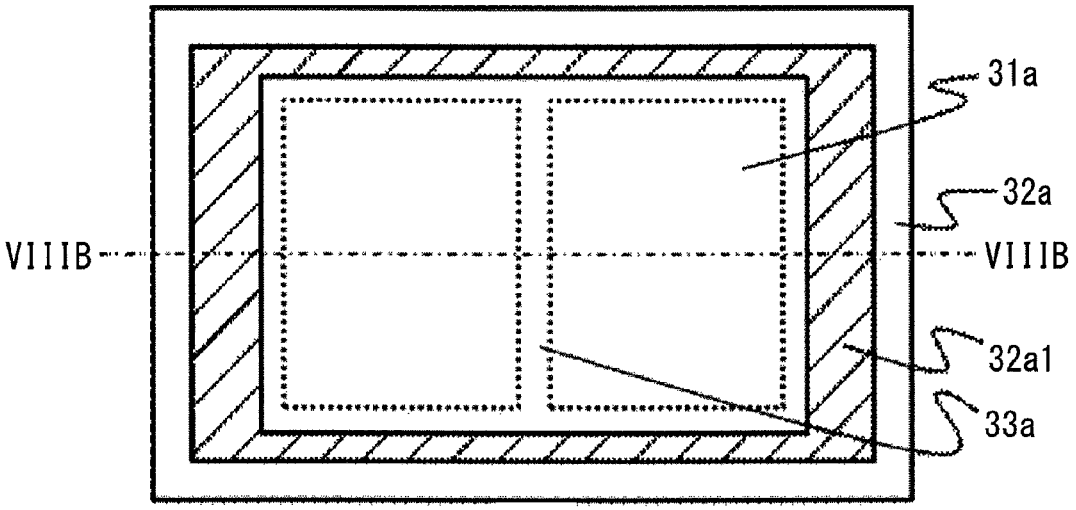
FIG. 8A is a schematic view of the vibration regulating portion which is provided on a communicating hole portion.
Figure 9A:
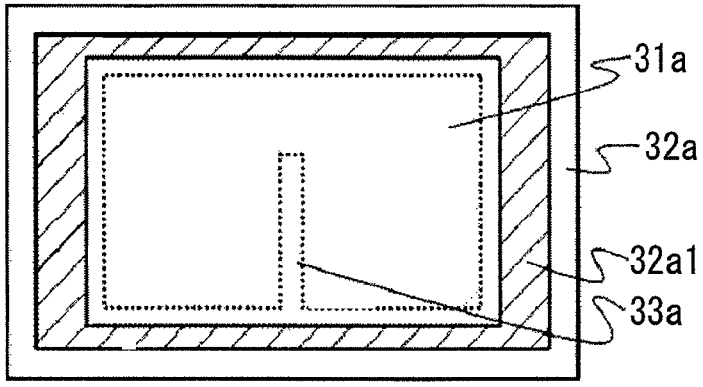
FIGS. 9A, 9B, 9C, and 9D are views of illustrating other examples of the structures of the vibration regulating portion.
Figure 9B:
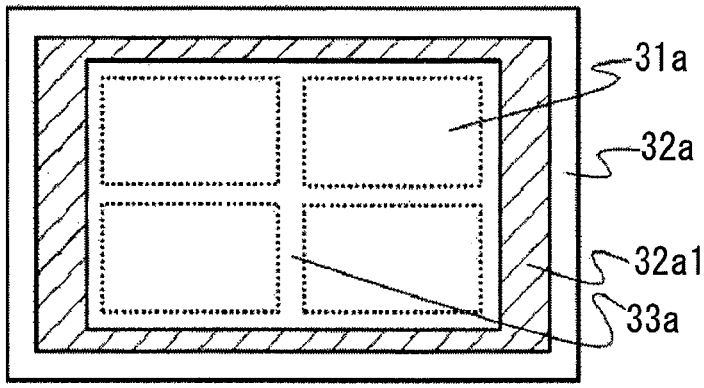

As illustrated in FIG. 8A, the vibration regulating portion 33*a* may be formed so as to divide the communicating hole 31*a* into two sections with a beam structure (beam shape). Further, as illustrated in FIG. 9A, the vibration regulating portion 33*a* may have such a structure that a rib is formed on the inner side of the communicating hole 31*a* and one end of the beam structure is a free end. Moreover, as illustrated in FIG. 9B, the vibration regulating portion 33*a* may have a shape of a plurality of beams so as to divide the communicating hole 31*a* into a plurality of sections.

The vibration regulating portion is not fixed to the filter member by heat welding, and is arranged in such a positional relationship that the vibration regulating portion is hit by the filter member if the filter member is vibrated. As a matter of course, when the filter member is fixed to the frame of the developing container by heat welding, even if the filter member and a part of the vibration regulating portion are fixed to each other by the heat welding, such a structure may fall within the scope of the present invention as long as the effects of the present invention are obtained.

Figure 9C:
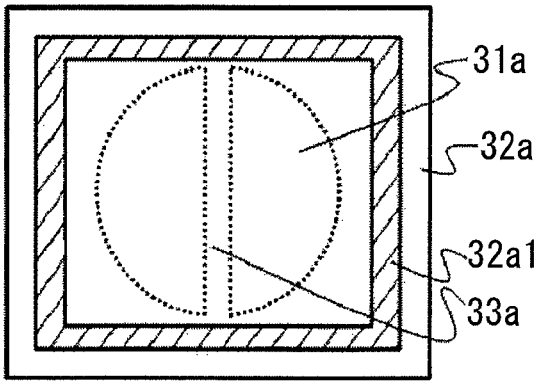
Figure 9D:
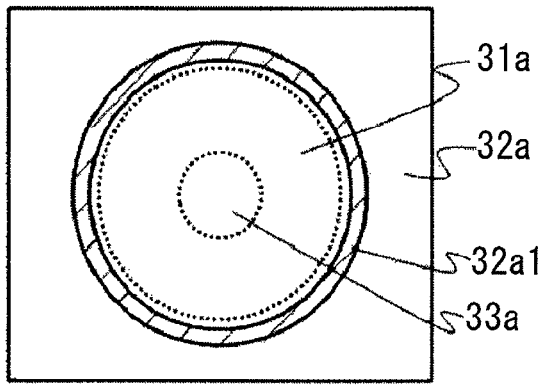

Further, as illustrated in FIG. 9C, the filter member fixing portion 32*a*1 may be provided around a circular communicating hole 31*a*, and the vibration regulating portion 33*a* may be provided so as to divide the communicating hole 31*a* into a plurality of sections with a beam shape. Further, as illustrated in FIG. 9D, the filter member fixing portion 32*a*1 may be provided along the communicating hole 31*a*, and the vibration regulating portion 33*a* may be brought into contact with the filter member 32*a* on the inner side of the communicating hole 31*a* alone.

It is more effective when satisfying the above-mentioned positional relationship that the vibration regulating portion is hit by the center of the filter member. This may be because the vibration is regulated at a portion of the filter member in which the amplitude of the vibration becomes largest.

That is, the structure of the vibration regulating portion 33*a* is not limited as long as the vibration regulating portion 33*a* is formed at a position at which the vibration regulating portion 33*a* is hit by the filter member on the inner side of the fixing area if the filter member is vibrated.

The fixing area herein refers to the area on the developing container side corresponding to the filter member fixing portion. Further, the inner side of the fixing area is preferred to be an inner side of the outer edge of the fixing area, but may instead be an inner side of an area defined by a part of the fixing area corresponding to the edge of the communicating hole.

In the embodiment, the filter member 32*a* is fixed to the cover 7*a*2 having the communicating hole 31*a* formed therein, and then the container 7*a*1 and the cover 7*a*2 are fixed to each other by ultrasonic welding, to thereby form the developing container 7*a*. At this time, the filter member 32*a* fixed to the cover 7*a*2 is also vibrated due to the vibration occurring between the container 7*a*1 and the cover 7*a*2 by the ultrasonic welding.

Figure 11:
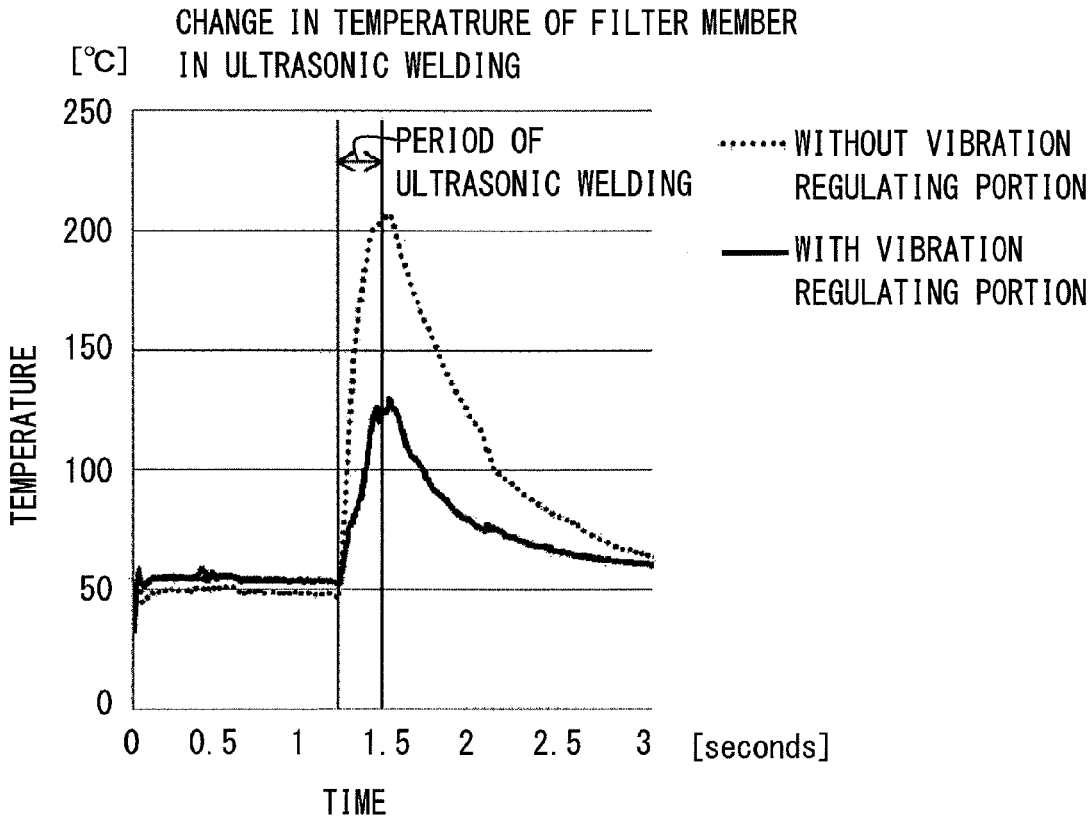
FIG. 11 is an example of a graph showing a change in temperature of the filter member in ultrasonic welding.

In this case, the vibrational energy of the filter member 32*a* is converted into thermal energy due to the friction and deformation occurring inside the filter member 32*a* to cause temperature rise. FIG. 11 shows a state of changes in temperature of the filter member 32*a* in the ultrasonic welding for the container 7*a*1 and the cover 7*a*2. The horizontal axis represents time and the vertical axis represents the temperature of the filter member 32*a* in the ultrasonic welding for the container 7*a*1 and the cover 7*a*2.

Figure 10A:
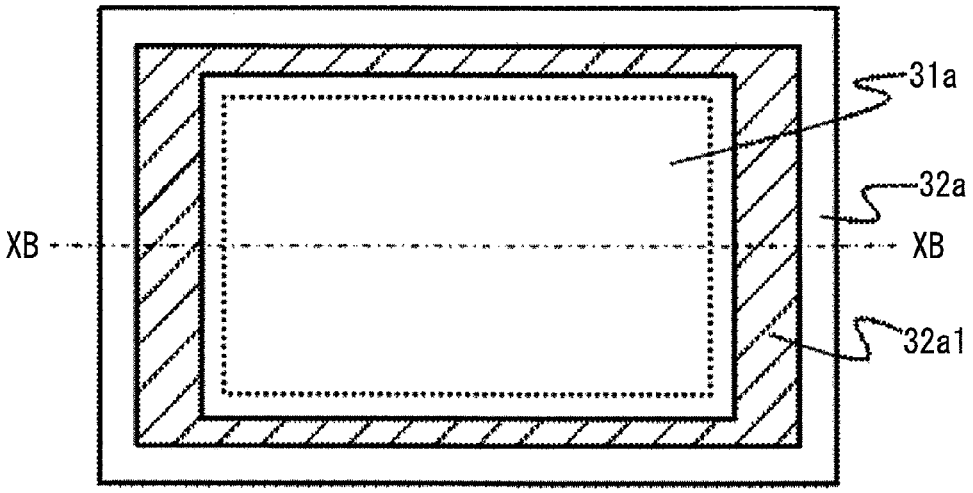
FIG. 10A is a schematic view of a communicating hole portion in a conventional example.

The broken line in the graph of FIG. 11 indicates a case where the vibration regulating portion is not provided as illustrated in FIG. 10A. The solid line in the graph of FIG. 11 indicates a case where the vibration regulating portion 33*a* is provided as illustrated in FIG. 8A.

Figure 8B:
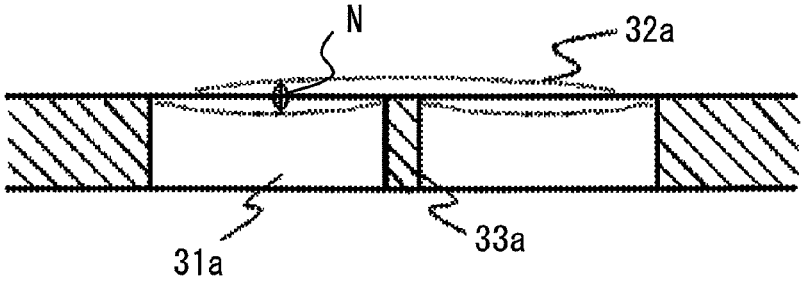
FIG. 8B is a schematic sectional view taken along the line VIIIB-VIIIB of FIG. 8A, of illustrating an amplitude of a filter member.
Figure 10B:
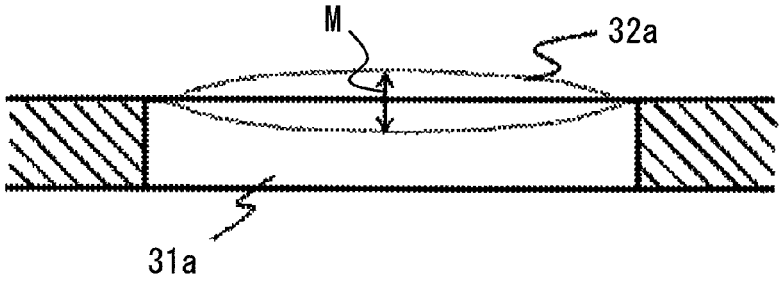
FIG. 10B is a schematic sectional view taken along the line XB-XB of FIG. 10A, of illustrating an amplitude of a filter member.

At this time, a maximum amplitude M of the filter member 32*a* illustrated in FIG. 10B and a maximum amplitude N of the filter member 32*a* illustrated in FIG. 8B in the case where the vibration regulating portion 33*a* is provided have a relationship of M>N because the amplitude of the filter member 32*a* is suppressed by the contact portion of the filter member 32*a* with the vibration regulating portion 33*a* in the case of FIG. 8B. Accordingly, the thermal energy generated in the filter member 32*a* can be suppressed as compared to the case where the vibration regulating portion is not provided.

Accordingly, it is possible to suppress the temperature rise caused by the vibrational energy of the filter member being converted into thermal energy due to the friction and deformation occurring inside the filter member. In particular, when the filter member is made of fibers, the thermal energy is easily generated due to the friction between the fibers by the vibration, but such a situation may be suppressed more effectively. Thus, it is possible to provide the developing container, the developing device, and the image forming apparatus in which the filter member is hard-to-melt with the heat generation.

Further, because the filter member becomes hard-to-melt, it is possible to reduce the risk of melting the filter member to cause decrease in ventilation performance.

Note that, in the embodiment, the vibration regulating portion 33*a* and the communicating hole 31*a* are provided in the cover 7*a*2 of the developing container 7*a* comprising the container 7*a*1 and the cover 7*a*2, and the filter member 32*a* is fixed so as to cover the communicating hole 31*a*. Conversely, the vibration regulating portion and the communicating hole may be provided in the container 7*a*1, and the filter member may cover the communicating hole of the container 7*a*1.

However, when the container 7*a*1 and the cover 7*a*2 are fixed to each other by ultrasonic welding, the cover 7*a*2 is more easily vibrated as compared to the container 7*a*1 having an enough volume to hold toner. Therefore, when the communicating hole 31*a* and the filter member 32*a* need to be provided in the cover 7*a*2, it is particularly effective to employ the vibration regulating portion 33*a* of the embodiment so as to suppress the vibrations of the filter member 32*a*.

When the filter member is fixed outside the developing container as in the embodiment, the vibration regulating portion is provided in an area in which the filter member covers the communicating hole. Accordingly, the vibration regulating portion receives an impact of toner which is generated from the inside of the developing container due to the impact during distribution, and hence the impact on the filter member can be reduced. Further, the vibration regulating portion is brought into contact with the filter member, and hence it is possible to reduce an impact of air which is generated from the outside of the developing container and is applied to the area in which the filter member covers the communicating hole.

Conversely, when the filter member is fixed inside the developing container, the vibration regulating portion is brought into contact with the filter member, and hence it is possible to reduce an impact of toner which is generated from the inside of the developing container due to the impact during distribution. Further, the vibration regulating portion is provided in an area in which the filter member covers the communicating hole, and hence the vibration regulating portion receives an impact of air which is generated from the outside of the developing container. As a result, the impact exerted on the filter member can be reduced.

Accordingly, it is possible to provide the developing container, the developing device, and the image forming apparatus which are highly resistant to the impact.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-279583, filed Dec. 21, 2011 and Japanese Patent Application No. 2012-266165, filed Dec. 5, 2012 which are hereby incorporated by reference herein in their entirety.

What is claimed is:

1. A developing container configured to contain developer, the developing container comprising:

a filter member covering a communicating hole through which an inside and an outside of the developing container are communicated with each other;

a fixing area where the filter member is fixed to the developing container; and a vibration regulating portion configured to regulate vibrations of the filter member on an inner side of the fixing area, the vibration regulating portion being positioned within a cross section of the communication hole, wherein the filter member is configured to allow passage of air and regulate passage of the developer, and wherein the vibration regulating portion is provided to regulate the vibrations of the filter member when the filter member is vibrated from a position where the filter member is separated from the vibration regulating portion to a position where the filter member contacts the vibration regulating portion.

2. A developing container according to claim 1, wherein the vibration regulating portion comprises a beam structure.

3. A developing container according to claim 2, wherein one end of the beam structure comprises a free end.

4. A developing container according to claim 1, wherein the communicating hole is divided into a plurality of sections by the vibration regulating portion.

5. A developing container according to claim 1, wherein the vibration regulating portion is provided so as to be hit by a center of the filter member.

6. A developing container according to claim 1, wherein the filter member is made of fibers.

7. A developing container according to claim 1, comprising a plurality of frames including a holding member configured to hold the developer and a cover configured to cover an opening of the holding member, wherein the filter member is fixed to the cover.

8. A developing container according to claim 1, wherein the vibration regulating portion is formed integrally with a frame which composes the developing container.

9. A developing device, comprising:

a developing container according to claim 1; and a developing member configured to develop a latent image by applying, to an image bearing member, developer contained in the developing container.

10. A developing device according to claim 9, comprising a sheet member of which a proximal end is fixed to the developing container and of which a distal end abuts against the developing member so that the sheet member prevents leakage of the developer from the developing container.

11. An image forming apparatus, comprising:

a developing device according to claim 10; and an image bearing member, wherein the image forming apparatus forms an image on a sheet.

12. A developer container according to claim 1, wherein the fixing area is positioned in a center region along a longitudinal direction of the developing container.

13. A developer container according to claim 1, wherein the fixing area is positioned in a recessed portion in a center region along a longitudinal direction of the developing container.

14. A developing container according to claim 1, wherein the vibration regulating portion isn't fixed to the filter member.

15. A method of manufacturing a developing container configured to contain developer, the method comprising:

providing a first frame and a second frame, the first frame provided with a communicating hole covered with a filter member and a vibration regulating portion configured to regulate vibrations of the filter member when the filter member is vibrated from a position where the filter member is separated from the vibration regulating portion to a position where the filter member contacts the vibration regulating portion, the vibration regulating portion being positioned within a cross section of the communicating hole; and joining the first frame and the second frame by vibration welding.

16. A method according to claim 15, wherein the vibration welding comprises ultrasonic welding.

17. A method according to claim 15, wherein a protrusion is provided on a welding surface of at least one of the first frame and the second frame.

18. A method according to claim 15, comprising forming the first frame and the vibration regulating portion integrally with each other.

19. A method according to claim 15, wherein the first frame comprises a cover configured to cover an opening of a holding member configured to hold the developer.

20. A method according to claim 15, wherein the fixing area is positioned in a center region along a longitudinal direction of the first frame.

21. A method according to claim 15, wherein the fixing area is positioned in a recessed portion in the center region along a longitudinal direction of the first frame.

22. A developing container configured to contain developer, the developing container comprising:

a filter member covering a communicating hole through which an inside and an outside of the developing container are communicated with each other;

a fixing area where the filter member is fixed to the developing container; and a vibration regulating portion configured to regulate vibrations of the filter member on an inner side of the fixing area when the filter member is vibrated from a position where the filter member is separated from the vibration regulating portion to a position where the filter member contacts the vibration regulating portion, wherein the filter member is configured to allow passage of air and regulate passage of the developer, wherein the vibration regulating portion is provided so as to be hit by the filter member if the filter member is vibrated, in order to regulate the vibrations of the filter member, and wherein the vibration regulating portion comprises a beam structure.

23. A developing container according to claim 22, wherein the vibration regulating portion is not fixed to the filter member.

24. A developing container configured to contain developer, the developing container comprising:

a filter member covering a communicating hole through which an inside and an outside of the developing container are communicated with each other;

a fixing area where the filter member is fixed to the developing container; and a vibration regulating portion configured to regulate vibrations of the filter member on an inner side of the fixing area when the filter member is vibrated from a position where the filter member is separated from the vibration regulating portion to a position where the filter member contacts the vibration regulating portion, wherein the filter member is configured to allow passage of air and regulate passage of the developer, wherein the vibration regulating portion is provided so as to be hit by the filter member if the filter member is vibrated, in order to regulate the vibrations of the filter member, and wherein the communicating hole is divided into a plurality of sections by the vibration regulating portion.

25. A developing container according to claim 24, wherein the vibration regulating portion is not fixed to the filter member.

26. A developing container configured to contain developer, the developing container comprising:

a filter member covering a communicating hole; and a vibration regulating portion configured to regulate vibrations of the filter member when the filter member is vibrated from a position where the filter member is separated from the vibration regulating portion to a position where the filter member contacts the vibration regulating portion, the vibration regulating portion being positioned within a cross section of the communication hole, wherein the filter member is configured to allow passage of air and regulate passage of the developer, and wherein the vibration regulating portion is not fixed to the filter member.

* * * * *